United States Patent [19]

Focke

[11] 4,085,564

[45] Apr. 25, 1978

[54] METHOD AND APPARATUS FOR MAKING TRAY-TYPE PACKETS

[75] Inventor: Heinz Focke, Verden, Aller, Germany

[73] Assignee: Focke & Pfuhl, Verden, Aller, Germany

[21] Appl. No.: 604,283

[22] Filed: Aug. 13, 1975

[30] Foreign Application Priority Data

Aug. 27, 1974 Germany ..... 2440885

[51] Int. Cl.[2] ..... B65B 11/08; B65B 11/50

[52] U.S. Cl. ..... 53/32; 53/66; 53/207; 53/218; 53/228

[58] Field of Search ..... 53/32, 66, 207, 209, 53/218, 228, 230; 83/425.2, 425.4

[56] References Cited

U.S. PATENT DOCUMENTS

| | | | |
|---|---|---|---|
| 1,461,919 | 7/1923 | La Malta | 83/425.2 |
| 2,858,657 | 11/1958 | Guthrie | 53/218 |
| 2,974,461 | 3/1961 | Dehler | 53/207 X |
| 3,022,615 | 2/1962 | Schroeder et al. | 53/66 |
| 3,086,337 | 4/1963 | Engleson et al. | 53/194 |
| 3,313,086 | 4/1967 | Johnsson | 53/32 |
| 3,478,487 | 11/1969 | Smith et al. | 53/66 |
| 3,673,763 | 7/1972 | Dorfmann | 53/209 X |
| 3,771,282 | 11/1973 | Flanagan | 53/230 |
| 3,837,265 | 9/1974 | Tokuno | 83/425.4 X |
| 3,885,373 | 5/1975 | Place et al. | 53/137 X |
| 3,911,774 | 10/1975 | Jennings | 83/425.2 |

FOREIGN PATENT DOCUMENTS

| | | | |
|---|---|---|---|
| 911,273 | 11/1962 | United Kingdom | 53/66 |

*Primary Examiner*—Harrison L. Hinson
*Assistant Examiner*—John Sipos
*Attorney, Agent, or Firm*—Sughrue, Rothwell, Mion, Zinn and Macpeak

[57] ABSTRACT

A method and apparatus for sizing and fitting cover flaps over tray-type packets such that an optimum packet is formed regardless of the compressibility of the material to be enclosed.

8 Claims, 3 Drawing Figures

METHOD AND APPARATUS FOR MAKING TRAY-TYPE PACKETS

BACKGROUND OF THE INVENTION (1) Field of the Invention

The invention relates to a method and apparatus for making packets with a cover flap which encloses the material in the packet in U-shape and whose side webs bear against a bottom or enter a bottom part formed with vertical side walls.

Tray-type packets of the kind specified take individual articles, more particularly small packets of roasted coffee, small bags, etc. The material in the packet - i.e., the individual article - are arranged on a tray consisting of a bottom surrounded by low side walls. The bottom ends of the side webs of a U-shaped cover flap enter the tray. The cover flap encloses the material in the packet at the top and in the zone of the side webs. Two opposite sides of the packet are therefore left open except for the side walls of the tray.

(2) Description of the Prior Art

In the making and filling of tray-type packets of the kind specified it has hitherto been necessary to take into account different dimensions in height of the material in the packet, which can also be caused by varying compressibility of the material. As a result tray-type packets are frequently not constructed uniformly enough. The different materials in the packet, namely for different constructional heights thereof, hitherto cover flaps of different sizes have been used, to enable their dimensions to be more or less adapted to the material in the packet to be enclosed.

The aforedescribed conventional steps are unsatisfactory, since they are expensive and do not always result in optimum packets.

Accordingly an object of the invention is to provide a method and apparatus for the making of tray-type packets and the like which allows in a very simple manner for the different constructional heights of the material and the packet.

SUMMARY OF THE INVENTION

According to the present invention, the foregoing and other objects are attained by the method of adapting the length and height of the side webs to the dimensions of the height of the material in the packet. Thus changes in the package dimensions resulting from compressibility, shrinkage, etc. of such materials are thereby accommodated and the excess lengths of the side webs are trimmed away and discarded. The apparatus for the performance of this method consists of two parting devices, more particularly a pair of circular blades provided for each side web, to trim away the excess cover flap; an adjustment mechanism to position the parting devices; a transport mechanism for the cover flaps; and folding arms to fold the cover flap around the material.

BRIEF DESCRIPTION OF THE DRAWINGS

A more complete appreciation of the invention and many of the attendant advantages thereof will be readily apparent as the same becomes better understood by reference to the following description when considered in connection with the accompanying drawings wherein.

DETAILED DESCRIPTION OF THE PREFERRED EMBODIMENT

Figure 1:
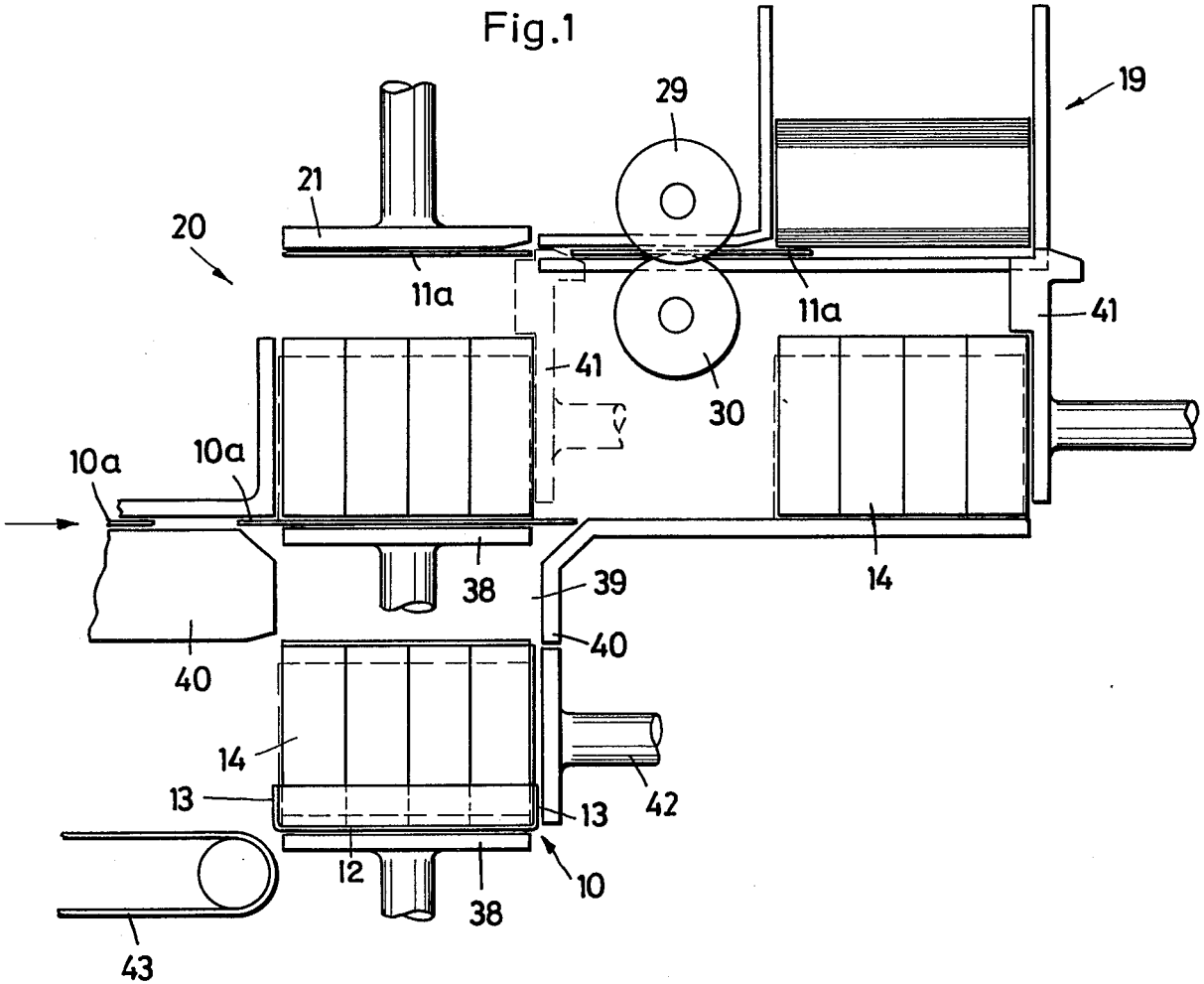
FIG. 1 is a diagrammatic side elevation of the whole apparatus.
Figures 2, 3:
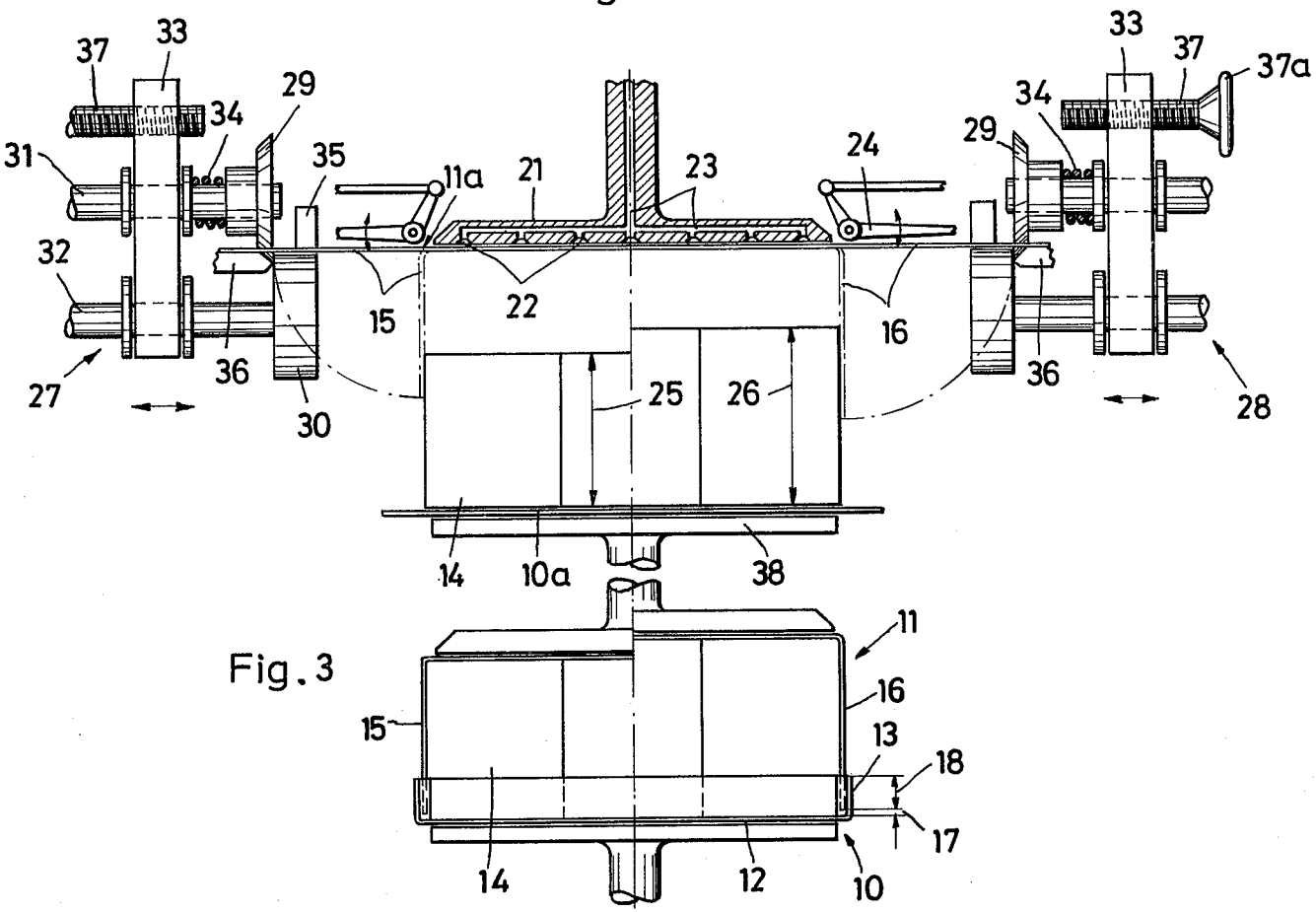
FIG. 2 is a front elevation of a portion of the apparatus.
FIG. 3 shows a detail of the apparatus as illustrated in FIG. 2, with the individual parts in a different relative position.

Referring now to the drawings wherein like reference numerals designate identical parts throughout the several views. The invention consists, as shown in FIG. 1, of a bottom tray 10 and a U-shaped cover flap 11. The tray 10 consists of a flat bottom 12 and low side walls 13 which adjoin all around. The material 14 in the packet, e.g. individual packets, small bags or the like is received in the bottom part 10 and enclosed by the cover flap 11 on the top side and on two opposite sides. The cover flap 11 enters the bottom part 10 by upright side webs 15, 16. As shown in FIG. 3, due to the elasticity of their material etc., side webs 15, 16 terminate at a certain distance 17 from the bottom 12 of the bottom part 10. The bottom ends of the side webs 15, 16 are connected to the adjoining side walls 13, for instance, by gluing. Side webs 15, 16 always enter the bottom part 10 with the same depth 18 of insertion even with different dimensions in height of the material 14 in the packet. FIGS. 2 and 3 each show two examples for material 14 of different height with correspondingly different relative positions of the parts of the apparatus.

The cover flaps 11 are formed from flat blanks **11*a* taken from a blank magazine 19 and fed to a folding station 20 where the particular blank 11*a* is fixed to the underside of a top punch 21. The top punch 21 has a plurality of suction bores 22 which discharge on the underside of the top punch 21 and, by connection to a suction channel 23 and a negative pressure source, retain the blank 11*a* and cover flap 11 in such a way that the parts forming side webs 15, 16 project. These parts are then folded over downwards by a suitable folding tool, for instance a two-armed folding lever 24, by 90° so that the top zones of the side webs 15, 16 bear against the top zones of the material 14 also fed to the folding station 20**.

Before being folded over, the side webs 15, 16 are cut to the length corresponding to the dimensions 25, 26 in height of the material 14 in the packet. To this end parting devices 27, 28 are provided laterally for each side web 15, 16 on the conveying path between the blank magazine 19 and the folding station 20. The parting devices 27, 28 can be adjusted in relation to the blanks **11*a*** and in relation to the path of movement thereof.

In the embodiment illustrated each parting device 27, 28 consists of two circular blades 29, 30 mounted by their drive shafts 31, 32 in a common bearing block 33. The two circular blades 29, 30 are disposed partially registering (cf FIG. 1) and are forced against one another by a spring 34. The top circular blade 29 is trapezoidal and the bottom circular blade 30 cylindrical. Cooperating with the circular blade 30 is a counter pressure roll 35 running on the top side of the blank **11*a*. The resulting parting device 27, 28 parts a strip of material forming an excess length 36 of the side web 15 or 16 laterally from those parts of the blank 11*a* which form the side webs 15, 16, so that the side webs 15, 16 are given the dimension 25 or 26 in height corresponding to the material 14** in the packet.

With the change in the dimensions 25, 26 in height the parting devices 27, 28 are adjusted relatively to one another. In the embodiment illustrated the whole bearing block 33 with the circular blades 29, 30 is adjusted, by a spindle 37 which, as shown, can be operated manually via a handwheel 37*a*. Alternatively, however, the adjustments can be performed by a motor, to which end the particular dimensions 25, 26 in height are sensed by a suitable device and the measured value is used for the adjusting impulse.

The operation should now be apparent. The cover flap 11, cut to size in the manner described hereinbefore with respect to the dimensions in height at the side webs 15, 16 is lowered by the top punch 21 in the U-shaped folded position until it rests on the material 14 in the packet. The downward movement is then continued being shared by the material 14 resting on bottom punch 38 with a still flat blank 10*a* for making the bottom part 10. During such downward movement the packet and the blank 10*a* for the bottom part 10 pass through a fixed mouth aperture 39 which is formed by lateral folding walls 40 disposed all around. This relative movement of the packet in relation to the mouth opening 39 folds the laterally projecting parts of the blank 10*a* upwards to form the side walls 13, while at the same time bearing against and being glued to the bottom ends of the side webs 15, 16 so that this operation completes the making of the packet. The finished packet is pushed below the mouth opening 39 by an ejector 42 on to a conveyor belt 43.

The packet according to the invention has the advantageous feature that the cover flap engages tightly around the contents of the packet. Another feature is that the blank 11*a* for forming the cover flap 11 is fed together with the material 14 by a double pusher 41 to the folding station 20 eliminating the need for separate mechanisms. The material 14 is pushed on to the bottom punch which is held in readiness and on which the blank 10*a* for the bottom part 10 already fed from the opposite side rests.

Although the invention has been described relative to a specific embodiment thereof, it is not so limited and many modifications and variations thereof will be readily apparent to those skilled in the art in the light of the above teachings. It is therefore understood that within the scope of the appended claims the invention may be practiced otherwise than as specifically described.

What is claimed as new and desired to be secured by Letters Patent of the United States is:

1. A method of making tray packets with a cover flap which encloses the material in the packet in a U-shape and whose side webs engage a bottom part formed with vertical side walls, comprising the steps of: forming from a flat blank a cover flap which has maximum dimensions for the height of the side webs in accordance with the dimensions in height of the material in the packet, resulting from detected dimensions; cutting the excess lengths of the side webs such that the side webs are fixed at a distance above the material resting on a blank forming the bottom part; folding the side webs laterally in the direction of the material; lowering the resulting U-shaped cover flap on to the material and further lowering the cover flap and the material together with a blank forming the bottom part and having parts projecting from the material such that by moving the blank relative to stationary folding walls, projecting parts thereof are folded upwards to form the side walls of the bottom part that engage the side webs.

2. In a method, as set forth in claim 1 wherein the flat blank for the cover flap is conveyed to a folding station and during said conveying the excess length of said side web is cut off.

3. An apparatus for producing packets having a cover flap which includes side webs which encloses material in the packet in a U-shape manner and said side webs engage a bottom part having upright walls, characterized by: cutting devices comprising a pair of circular blades associated with each side web, said blades being adjustable in respect to the excess length to be cut from the side webs in accordance with the height of the material to be packaged; holding means for holding the suitably cut blank above the material and for lowering the blank onto the material, a folding tool for folding the side webs onto the tops of the lateral side faces of the material in the packet prior to said lowering of the blank and a second folding tool fixed relative to said packet and having a aperture wherein lowering of the bottom part together with the material and the cover flap through said aperature folds the projecting parts of said bottom part up against said side webs.

4. An apparatus as set forth in claim 3, characterized in that each cutting device (27, 28) is individually adjustable.

5. An apparatus as set forth in claim 3, characterized in that the two circular blades (31, 32) are mounted by their drive shafts (31, 32) in a common adjustable bearing block.

6. An apparatus as set forth in claim 5, characterized in that the bearing block is adjusted by a mechanical drive, more particularly by a spindle.

7. An apparatus as set forth in claim 3, characterized in that the blank (11) for the cover flap (11) is fed together with the material in the packet to a folding station, more particularly by a common double pusher.

8. An apparatus as set forth in claim 3, characterized in that the blank for the cover flap and the cover flap itself can be fixed at the folding station at a distance above the material in the packet by a top punch whose underside is formed with suction bores.

* * * * *